United States Patent [19]

Demurger

[11] Patent Number: 5,062,328

[45] Date of Patent: Nov. 5, 1991

[54] PLASTIC WRENCH WITH METAL INSERT

[75] Inventor: Jean P. Demurger, Roanne, France

[73] Assignee: Demurger et cie, France

[21] Appl. No.: 486,090

[22] Filed: Feb. 28, 1990

[30] Foreign Application Priority Data

Mar. 2, 1989 [FR] France ..... 89 02997

[51] Int. Cl.[5] ..... B25B 13/00

[52] U.S. Cl. ..... 81/186; 81/185

[58] Field of Search ..... 81/186, 185

[56] References Cited

U.S. PATENT DOCUMENTS 1,314,044 8/1919 Buker ..... 81/185
2,898,793 8/1959 Fedeson .
2,909,954 10/1959 Rhoads .
4,864,898 9/1989 Tricinella ..... 81/3.09

FOREIGN PATENT DOCUMENTS 926946 4/1947 France .
1556391 6/1969 France .
1251419 10/1971 United Kingdom .
2018179 10/1979 United Kingdom .
8404721 12/1984 World Int. Prop. O. .

*Primary Examiner*—Frederick R. Schmidt
*Assistant Examiner*—Lawrence Cruz
*Attorney, Agent, or Firm*—Wall and Roehrig

[57] ABSTRACT

A plastic wrench consitsint of a handle (2) and a gripping head (3,4), having a polygonal opening (5,6) in which there is embedded an open metal insert (10,11), likewise polygonal, and the walls of which form gripping jaws, wherein the walls (12,13,14,15) of the insert (10,11) forming the jaw are parallel and protrude slightly from the lateral faces (16–19) of the openings (5,6) of each gripping head (3,4), whereim the metal insert (10,11) is made from a hard, flexible and resilient metal having a coefficient of hardness of between 45 and 50 HRC, and wherein, in the region of the jaws (12–15), the thickness E2 of the insert (10,11) is between 0.5 and 0.7 times the thickness E1 of the gripping head (3,4).

7 Claims, 2 Drawing Sheets

PLASTIC WRENCH WITH METAL INSERT

The invention relates to an improved plastic wrench, the gripping head of which has an embedded metal insert forming a clamping jaw or gripping jaw.

BACKGROUND OF THE INVENTION

1. Description of the Prior Art

It is well known to make wrenches from glass fiber-reinforced plastic, in the head of which a metal insert forming a clamping jaw or gripping jaw for tightening (or loosening) is embedded. Wrenches of this type have already been described, for example, in the documents U.S. Pat. No. 2,909,954 and GB-A-1,251,419. For better absorption of the gripping stresses which are exerted at the point of contact between the insert and the nut, the use of polygonal inserts has been recommended. Although known for a very long time, these wrenches have not been developed, since, owing to the effect of the gripping forces, in time, the insert has the unfortunate tendency to turn in the head.

In the document GB-A-2,018,179, it has been suggested to provide the jaws of the opening with a thickness of metal. Unfortunately, the strength of these wrenches differs little from that of the plastic handle, which considerably limits their use.

In the document WO-84/04,721, it has therefore been suggested to cover the jaws with a U-shaped metal insert over their entire thickness. This arrangement admittedly improves the tightening torque by almost half, i.e. permits maximum tightening torques of 30 to 40 Nm to be obtained, depending on the opening of the jaws, but it does not permit the levels which are required by the industrial standards and which, for openings of 13 to 16 millimeters, are between Nm 45 to 60, to be attained.

2. Summary of the Invention

The invention eliminates these disadvantages. Its object is an improved wrench of the type in question, i.e. of plastic, which is easy to manufacture and does not have the above disadvantages. Its object is more particularly a wrench of the type in question which is light and easy to manufacture, even on a small scale, but which performs comparably with existing metal wrenches and which permits performances no worse than those of the standards currently in force to be obtained.

This plastic wrench, consisting of a handle and a gripping head which has a polygonal opening in which there is embedded an open metal insert, of hard steel and likewise polygonal, and the walls of which form jaws for tightening (or loosening), is defined in that the walls of the metal insert forming jaws are parallel to the lateral faces of the polygonal opening of each gripping head and protrude slightly from these lateral faces, and in that, in the region of the jaws, the thickness of the insert is between 0.5 and 0.7 times the thickness of the gripping head.

In other words, the invention consists in arranging the walls of the hard and resilient metal insert to be slightly protruding from the lateral faces of the opening of the head, and in having to determine an optimum ratio between the thickness of the insert and that of the actual gripping head so that, when tightening (or loosening), the stresses are essentially concentrated on the insert itself and no longer on the actual gripping head, which permits the required industrial standards of between Nm 45 to 60 to be attained.

Advantageously, in practice:

- it has been determined that the larger the wrench opening, the greater the protrusion should be; thus, it has been observed that for the smallest openings, i.e. for 10 mm wrenches, this protrusion could be of the order of a few tenths of a millimeter, for example three tenths, whereas for large wrenches (32 mm wrenches), this protrusion can be of two to three millimeters;
- the thickness of the insert must be not less than half the thickness of the gripping head, but preferably less than 0.7 times this thickness; in fact, if this last ratio is exceeded, the residual thickness of the plastic is too small to be able to absorb properly the stresses transmitted by the insert so that, in time, cracks will appear; similarly, if this ratio is less than half, when tightening, some of the stresses are distributed in the head, which likewise becomes brittle;
- the material used for the insert is a metal having a coefficient of hardness of between 45 and 50 HRC, preferably in the region of 48 to 50 HRC; in fact, it has been observed that if the coefficient of hardness is less than 45, the head of the nut might, in time, cut into the walls of the insert forming the clamping jaws; on the other hand, if this hardness exceeds 55 HRC, this risk of deformation is eliminated but there is the risk that the insert might break in time; as already stated, use is preferably made of metals whose coefficient of hardness is between 48 and 50, i.e. flexible, resilient, but non-brittle metals; preferably, a steel of the type 35 CD4 or 55 S7 is used;
- the body (handle + gripping head) of the wrench is, as already stated, made from plastic reinforced with glass fibers or the like; plastics with a Young's modulus greater than 100 MPa are preferably used; the proportion of the glass fibers and plastic by weight increases with the opening and is at least 30% for small wrenches and may amount to 60% for large wrenches; the plastics used are preferably high-performance plastics, such as those of polyamide, preferably polyarylamide, or even of thermosetting resin, in particular vinyl ester;
- the faces of the insert intended to be embedded in the plastic gripping head undergo an appropriate treatment intended to improve the adhesion to plastics, such as sandblasting, serration or grooving; similarly, the adhesion between the insert and the plastic gripping head is improved by arranging in the insert through holes which, during the injection of the plastic, will fill up with the latter;
- the insert in plan has an irregular, generally hexagonal shape which is symmetrical relative to the median axis of the opening and in which a symmetrical opening, the walls of which form jaws, is arranged;
- the ratio between the large surface of the metal insert and the large surface of the plastic gripping head, excluding the gripping opening, is at least 70%, preferably of the order of 75%.

The manner in which the invention can be achieved and the advantages which ensue therefrom will become more apparent from the following exemplary embodiment, supported by the accompanying figures.

DESCRIPTION OF THE PREFERRED EMBODIMENTS

Figure 1:
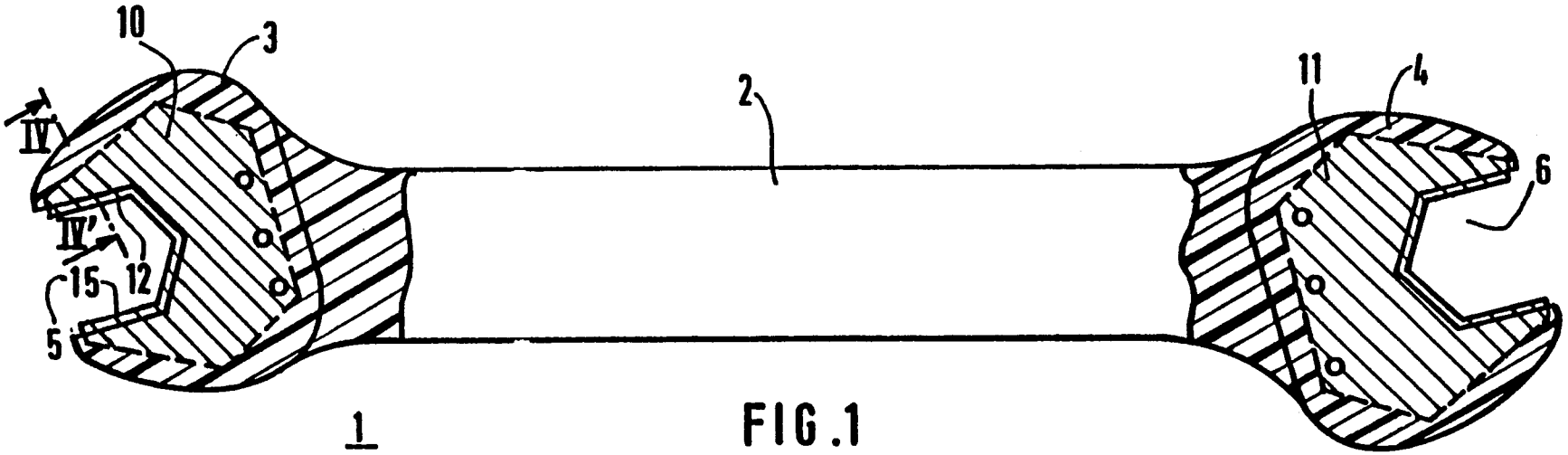
FIG. 1 shows a top view of an open-end wrench according to the invention.

The open-end wrench indicated by the general reference (1), shown in FIG. 1, is a wrench substantially to scale having 22/24 mm openings. It consists essentially of a handle (2) and two gripping heads (3) and (4) respectively, each having an opening (5) and (6). The opening (5) (see FIG. 3) is intended to receive a 22 mm bolt or nut (7), while the opening (6) is intended to receive a 24 mm nut, bolt or the like. The handle (2) and the heads (3,4) are of polyarylamide reinforced with 60% by weight of glass fibers, marketed under the trade name "IXEF" by SOLVET.

In a known manner, each of these openings (5,6) has a pentagonal shape, symmetrical relative to the median axis (I,I') (see FIG. 3), and has a metal insert (10,11) embedded in a head (3,4). These inserts (10,11) are of 35 CD4 steel having a coefficient of hardness of 48 HRC.

Figure 2:
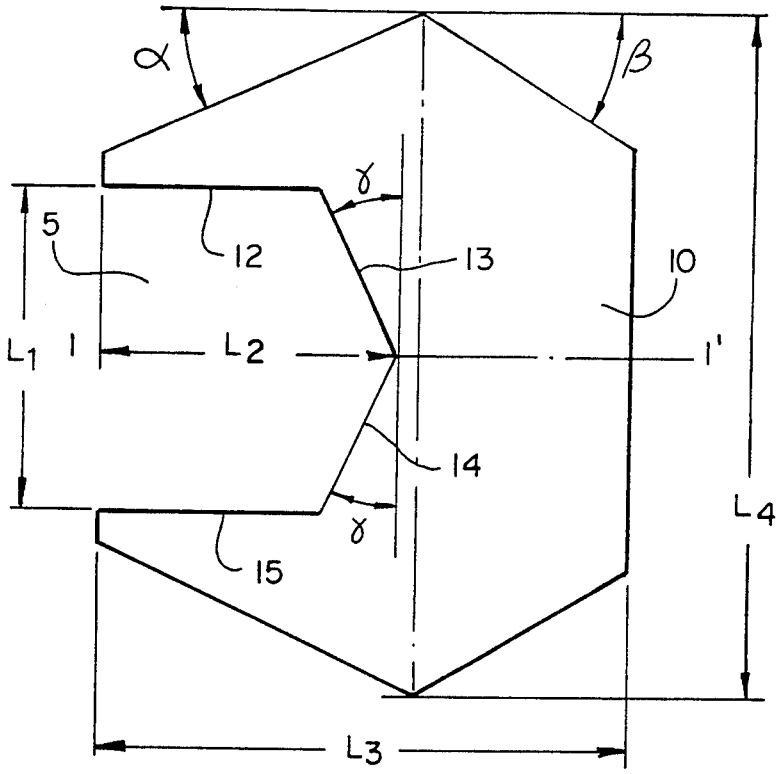
FIG. 2 is a representation, viewed from above, of an insert characteristic of the invention.
Figure 3:
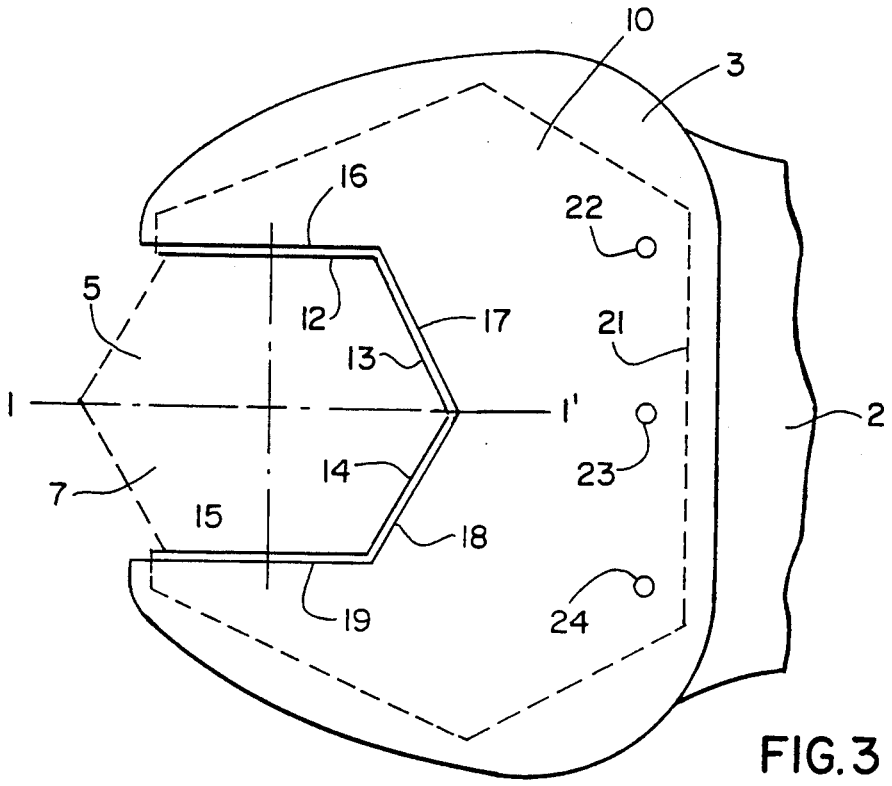
FIG. 3 is an enlarged view of a gripping head characteristic of the invention.

These inserts (10,11) have an irregular, generally hexagonal shape which is, however, also symmetrical relative to the median axis (I,I') of the opening (5,6) (see FIGS. 2 and 3).

According to a first important characteristic of the invention, the four active walls (12,13,14,15) of the insert (10) protrude from the corresponding parallel walls (16,17,18) of the opening (5) of the gripping head (3), for example by approximately 1.5 millimeters. Similarly, the walls of the insert (11) protrude from those of the opening (6).

In a second characteristic of the invention corresponding to the embodiment shown in FIGS. 2 and 3, the metal insert (10,11) has the following characteristics:

opening L1: 32 mm
depth L2: 30 mm
length L3: 54 mm
width L4: 68 mm
angle alpha: 25°
angle beta: 30°
angle gamma: 27°

The mutual junctions of the active walls (12,13,14) are formed by radii, not shown, of approximately one millimeter.

In an advantageous embodiment, the main horizontal surfaces of the inserts (10,11) are sandblasted, grooved or the like, so as to facilitate adhesion to the plastic during injection. In a variant, in order to facilitate this adhesion, the inserts (10,11) have, in the vicinity of the base (21), through holes (22,23,24), for example of two to four millimeters in diameter, through which the plastic passes during injection.

Figure 4:
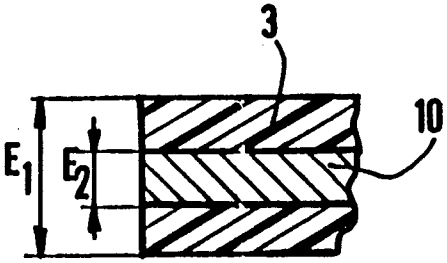
FIG. 4 is a section along the axis IV—IV' of FIG. 1.

According to another essential characteristic of the invention (see FIG. 4), the thickness E2 of the characteristic insert (10,11) is not less than half, and preferably about 0.6 times, the thickness E1 of the gripping head (3,4), at least in the region of the walls (12–15) concerned. The main surface of the characteristic insert (10,11) represents approximately three quarters of that of the gripping head (3,4) concerned.

The ratio (see FIG. 3), excluding the opening (5), between the surface of the metal insert (10) and the surface of the gripping head (3) is between 75 and 80%.

This wrench enables a resisting torque in the region of that of the standards currently in force, in particular ISO standards, to be obtained, which it has not been possible to obtain hitherto with plastic wrenches. In fact, for small wrenches (10 mm opening), a resisting torque is readily obtained which is almost two times the standard as against only 40% for the prior art, and for large wrenches (openings of 30 mm and larger), a resisting torque equal to that of the standard is obtained.

In the same way as other plastic wrenches, the wrenches according to the invention are light and insulating. In addition, phenomena of cracking or loosening of the insert in the gripping head do not occur in time, which is due to the characteristic hexagonal shape of the insert and the surface ratio with the gripping head.

As a result, these wrenches can be used successfully in industry or do-it-yourself either in the form of open-end wrenches, adjustable wrenches or socket wrenches, etc.

I claim:

1. A high strength molded wrench for engaging a grippable member that includes:

a metal insert having parallel top and bottom walls, end walls and an opening passing inwardly through one end wall to form a pair of jaws having opposed walls for engaging a grippable member, body means formed of a high strength moldable material having a head that is molded over said insert to encompass the top wall, bottom wall and end walls said insert, said head having an opening that complements the opening in the insert to expose only the opposed gripping walls, and an elongated handle means extending from said head.

2. The wrench of claim 1 further including aperture means in said insert for receiving said moldable material therein to securely hold the insert within the body means.

3. The wrench of claim 2 wherein the aperture means includes a plurality of holes passing through the top and bottom walls of the insert which are filled with said moldable material when the body means is molded over said insert.

4. The wrench of claim 2 wherein said aperture means includes surface grooves that are filled with said moldable material when the body means is molded over said insert.

5. The wrench of claim 1 wherein the thickness of the insert is about between 0.5 and 0.7 times the thickness of said head.

6. The wrench of claim 1 wherein the body means is molded from a glass fiber reinforced polyamide.

7. The wrench of claim 1 wherein the opposed walls of the insert are perpendicular to the top and bottom walls thereof and protrude into the complementary opening formed in the head.

* * * * *